US005794880A

United States Patent [19]

Liljedahl

[11] Patent Number: 5,794,880

[45] Date of Patent: Aug. 18, 1998

[54] ROPE DRUM

[76] Inventor: Gunnar Liljedahl, Pellvägen 4, Luleå, Sweden

[21] Appl. No.: 669,349

[22] PCT Filed: Nov. 18, 1994

[86] PCT No.: PCT/SE94/01100

§ 371 Date: Jul. 2, 1996

§ 102(e) Date: Jul. 2, 1996

[87] PCT Pub. No.: WO95/19813

PCT Pub. Date: Jul. 27, 1995

[30] Foreign Application Priority Data

Jan. 19, 1994 [SE] Sweden ..... 9400139

[51] Int. Cl.[6] ..... B65H 75/30; B66D 5/18

[52] U.S. Cl. ..... 242/396; 182/233; 254/377

[58] Field of Search ..... 242/396, 381, 242/156; 182/233, 238; 254/377; 188/295, 317, 319

[56] References Cited

U.S. PATENT DOCUMENTS

| | | | |
|---|---|---|---|
| 238,552 | 3/1881 | Barlow | 182/233 |
| 3,595,528 | 7/1971 | Virkki | 242/396 |
| 4,047,487 | 9/1977 | Wyss | 242/396 |
| 4,452,430 | 6/1984 | Kankkunen | 242/396 |
| 5,046,402 | 9/1991 | Lagace | 254/377 |

FOREIGN PATENT DOCUMENTS

| | | | |
|---|---|---|---|
| 2919899 | 11/1980 | Germany | 182/233 |
| 204618 | 12/1983 | Netherlands | 182/238 |
| 210426 | 6/1984 | Netherlands | 182/233 |
| 349944 | 10/1972 | Sweden . | |
| WO92/12088 | 7/1992 | WIPO . | |

*Primary Examiner*—John M. Jillions

*Attorney, Agent, or Firm*—Jacobson, Price, Holman & Stern, PLLC

[57] ABSTRACT

A driven barrel of a winch device includes a closed cylindrical space (16) which is concentric with the barrel and accommodates a piston (17) which can move on an axis (12) from one end of the cylindrical space to the other and is in non-rotatable connection (19, 20) with the inside of the barrel. The axis (12) has screw threads (15) and the piston (17) has a center bore with screw threads meshing with the screw threads of the axis. The cylindrical space encloses a fluid and the piston (17) is given a leak from one side of the piston to the other. In order to stop the loaded rope unwinding from the barrel if the rotation speed of the barrel should increase over a certain value the leak is in the form of a canal (21) which accommodates a valve means including a valve housing and a valve body (22). The valve means stops the fluid flow over the valve body in one direction at a certain pressure drop over the valve body.

3 Claims, 2 Drawing Sheets

ROPE DRUM

The present invention relates to an improvement in a driven barrel of a winch device to stop a rope to be unwound from the barrel when the rotation speed of the barrel increases over a certain value in one direction, whereat the driven barrel includes a closed cylindric space which is concentric with the barrel and accomodates a piston, which can move on an axis from one end of the cylindric space to the other in non-rotatable connection with the inside of the barrel, the axis having screw threads and the piston having a center bore with screw threads meshing with the screw threads of the axis, whereat the cylindric space contents a fluid and the piston is given a leak from one side of the piston to the other side.

The invention particularly relates to a winding barrel in a hoisting machine intended for sick or handicapped persons. In such cases the hoisting machine is disposed on a ceiling or a stand and by winding up a cable or the like on its barrel a person in a harness is lifted. It is important that such machines are safe, compact and easily operated. The barrel is driven via a gearing, or some form of a belt driving and not infrequently it happens that there is a machine or power supply failure. This may result in the barrel rotating freely counter to its winding direction, such as to allow the cable to run either during hoisting or lowering, thus causing the person to fall to the floor or on to some other structure and possibly resulting in an injury. Limit switches are indeed often provided for the extreme positions for the barrel, for inhibiting the drive to the barrel, or stopping it from rotating, but disturbances occur relatively often in these functions. There is also the ambition to make the drive means as small and as cheap as possible, which can lead to these means not standing up to overloads. In addition, a continuously driven barrel has no natural end positions and should operation be incorrect, this could lead to the cable being wound up on the barrel in the wrong direction of rotation. This would mean that the limit switches function in the wrong order and wrong lift hights would be obtained for the hoisting apparatus. The object of the invention is to stop the rotation of the barrel if the rotary speed in one direction should happen to increase over a certain value.

An embodiment of the invention will now be described with reference to the enclosed drawings.

Figure 1:
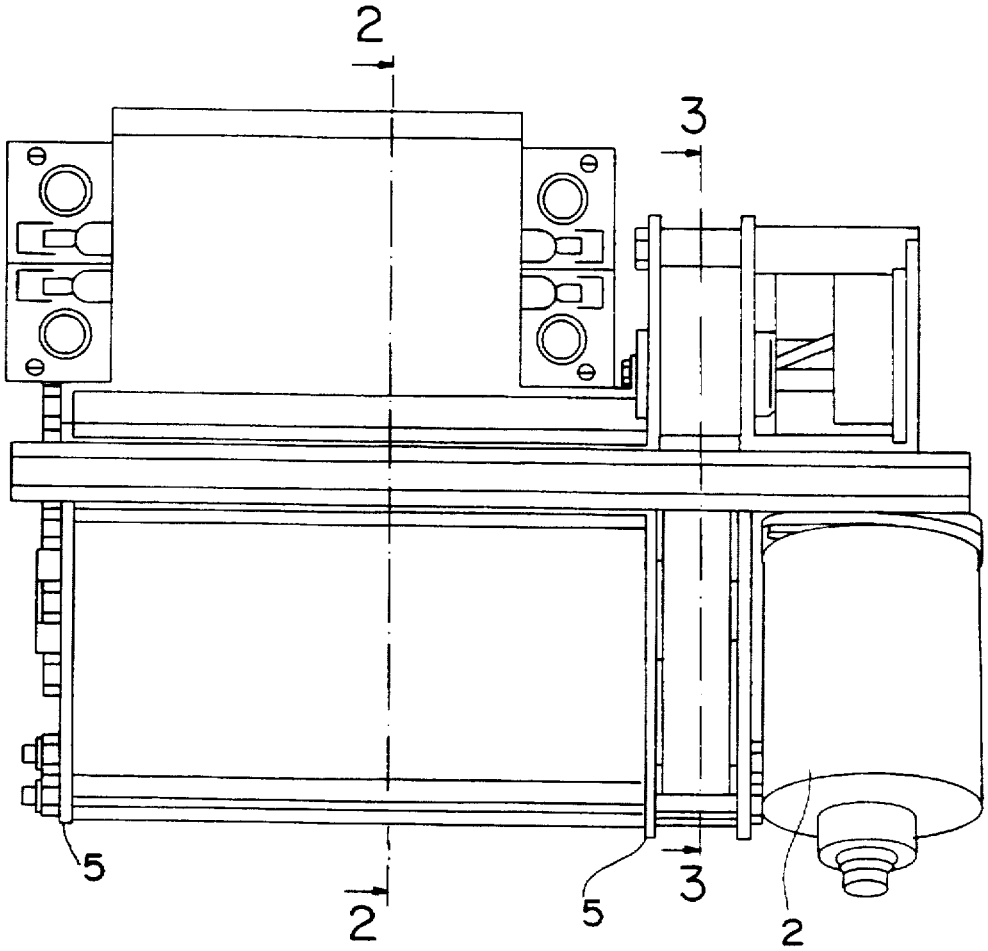
FIG. 1 is a side view of a barrel of a winch and its driving motor.
Figure 2:
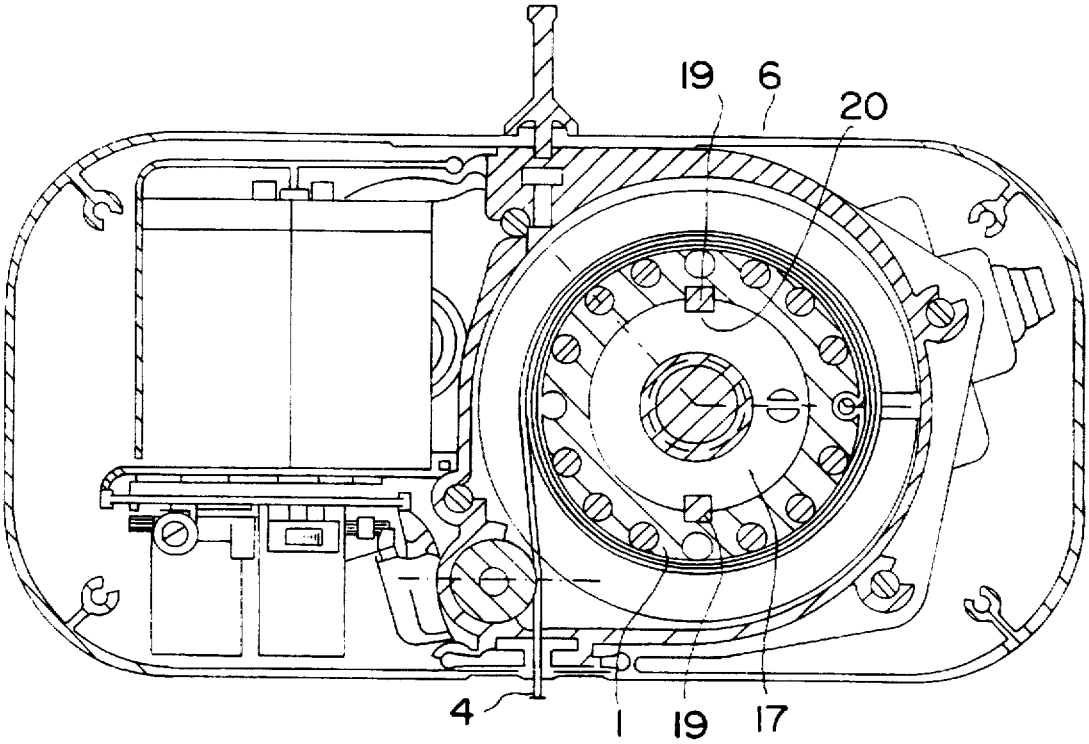
FIG. 2 is a cross section through the barrel along the line A—A in FIG. 1.
Figure 3:
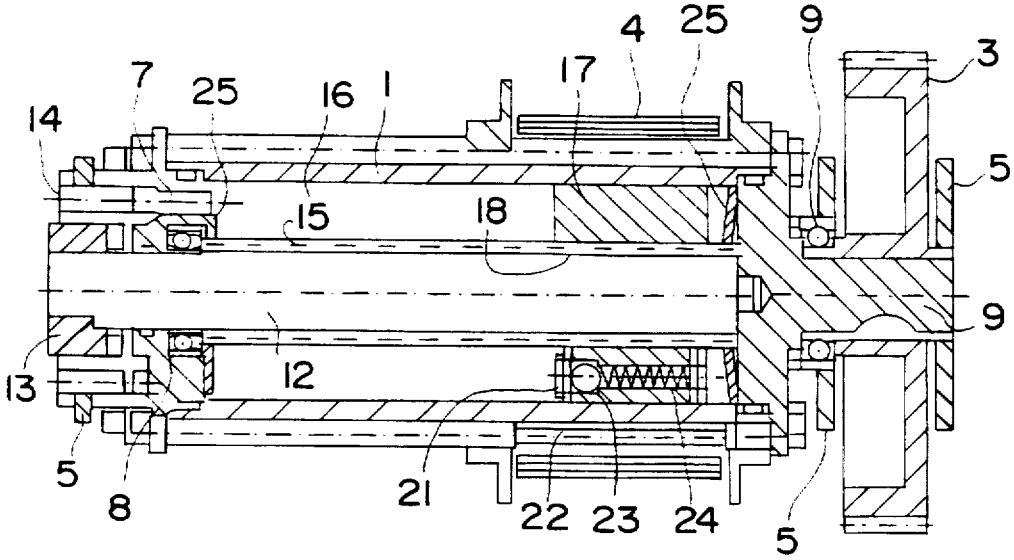
FIG. 3 is a longitudinal section through the barrel, showing the supporting axis and driving gear along the line B—B in FIG. 2.

The hoisting device thus includes a barrel 1, which is driven to rotate by a motor 2 via a gear 3. The driving means are arranged at the right end of the barrel 1. A belt is denoted by 4 and is wound up on the barrel. The barrel is supported by bearings in end walls 5 of a housing 6, which is supported by an elevated situated arm or is supported by a ceiling. The barrel 1 thus is supported in its left end by the end wall 7 and a bearing 8 and in its right end by the right end wall 5 via a bearing 9 and a shaft pivot, which is extended from the right end wall of the barrel. The axis 12 extends through the barrel 1 and supports the bearing 8 of the barrel in the left end wall 7 of the barrel but is fixed in the left end wall 7 by a washer 13 and screws 14. The barrel 1 can thus freely rotate in relation to the axis 12. The axis 12 is provided with a helical thread 15 of suitable pitch. As can be seen the barrel has a cylindrical space 16 between its two ends. A piston 17 is arranged within the cylindrical space 16. The piston runs within the cylindrical space to-and-from and is provided by a central bore having threads 18 of a pitch in correspondence with the form and pitch of the threads 15. The piston 17 is further fixed to the barrel 1 by two keys 19 in the inner side of the barrel and two keyways 20 on the outside of the piston, see FIG. 2. Keys and keyways are extended in the longitudinal direction of the axis 12 and parallel with the axis 12, whereby the piston 17 will be non-rotatable in relation to the barrel 1 and will move along the axis 12 because of the thread connection with the axis when the barrel is rotated, see FIG. 3. The direction of the movement will depend on the rotary direction of the barrel 1 and the direction of the helix form of the threads.

The space 16 is filled with a suitable fluid, preferably oil. A canal 21 is bored axially through the piston 17 and the canal connects the left side of the piston with its right side so that oil will flow through the canal from the left side of the cylindric space to the right side thereof and vice versa. When the barrel 1 is rotating, piston 17 will also move in one of its two axial directions and oil will flow through the canal 21.

A ball 22 is located in the left end of the canal 21. To the right of the ball 22 in the canal there is a valve seat 23 against which the ball closes the canal when the ball is forced to the right. The canal 21 has a larger diameter than the ball and oil can pass in the space between the outside of the ball and the inside of the canal. A spring 24 is placed in the right end of the canal and forces the ball 22 away from the seat 23. A pin or the like prevents the ball 22 to be forced out of the canal 21 to the left. When the barrel is rotating in either direction and the piston moves axially and rotates with the barrel, oil will pass through the canal to the right when the piston moves to the left and vice versa. The oil can flow freely in both directions through the canal 21 with one exception and that is to the right in FIG. 3 when the flow speed is increased over a certain value. Thus, when the flow speed to the right reaches a certain great value, the pressure drop over the ball will cause the ball to be moved to the right against the force of the spring 24 and the bail will be pressed against the valve seat 23. The oil is hereby prevented to flow through the canal 21 and the piston 17 can not be displaced axially, which will stop the rotation of the barrel in the direction, which corresponds to the displacement of the piston to the left in FIG. 3. The barrel is thus stopped by that the ball stops the flow of oil through the canal 21 in the direction to the right in FIG. 3.

The described stop operation is used as an emergency stop for the barrel if, for instance, when lowering a person the driving motor or the transmission to the barrel should collapse. The invention thus prevents the barrel to assume a too high not controlled speed in one direction of rotation. If this happens the rotation of the drum will be stopped.

It is possible to double the operation within the scope of the invention, by either arranging a further canal and a ball but having an opposite operation mode so that the emergency stop will be in the opposite direction of rotation as to the one described or the ball can be situated between two valve seats and two springs so that the ball can close against one valve seat in both flow directions of the oil through the canal. The piston 17 also decides the two end positions for winding in and winding up of the rope 2. The piston thus stops the rotation of the barrel when the barrel has assumed its left position and right position respectively. A washer 25 is placed at the both end positions in order to eliminate shearing between the screw threads and in order to decrease the thrust when the piston hits the inner end side of the barrel in its end positions. These washers will give a smooth braking for the piston 17 when it reaches both end positions.

A best mode of the invention has been described above but within the scope of the invention further embodiments are possible. The placement of the cylinder space and the piston can be varied in relation to the place on the barrel where the rope is wound up and thus it is possible to arrange the cylindric space outside the barrel by forming an elongation of the barrel. The axis 12 and/or the barrel can be supported in a different manner than described above. The connection between the piston and the barrel can be designed by that a rod is extended inside the barrel between its two ends and in parallel with the axis 12 and passes through a hole in the piston whereby the rod is placed beside the axis 12 and is fixed in the end walls of the barrel, so that the piston 17 can not rotate in relation to the barrel 1 but move along the axis 12. There are also other embodiments of valves which function as described above. Thus, the valve body can have a different form than a ball form. Other means than a spring can be used in resisting the valve body to be pressed against the valve seat. The inventive idea according to the invention is that a pressure drop over the valve body at high flow speeds will cause the valve body to be pressed against the valve seat and thereby closing the valve and stopping the flow of oil.

I claim:

1. Improvements in a driven barrel of a winch device to stop a rope to be unwound from the barrel when the rotation speed of said barrel increases over a certain value in one direction, said driven barrel including a closed cylindric space which is concentric with said barrel and accommodates a piston, which is movable on an axis from one end of said cylindric space to the other in non-rotatable connection with the inside of the barrel, said axis having first screw threads and said piston having a center bore with second screw threads meshing with said first screw threads of the axis, wherein said cylindric space contains a fluid and said piston is given a leak from one side to the other side of said piston, said leak being in the form of a canal through said piston in its axial direction, said canal accommodating a valve means including a ball freely movable in said canal and said ball closes against a valve seat in said canal against the force of a spring when the flow rate in a direction opposite to said spring force causes a pressure drop high enough to overcome said spring force.

2. The device as claimed in claim 1, wherein said non-rotatable connection comprises an axial key way in either the outside of said piston or the cylindrical inner surface of said barrel and an axial key in the respective opposing surface.

3. The device as claimed in claim 1, wherein said two end positions of the piston in said cylindric space have stops for said piston.

* * * * *